US011060524B2

(12) United States Patent
Chou

(10) Patent No.: US 11,060,524 B2
(45) Date of Patent: Jul. 13, 2021

(54) FAN BACKFLOW PREVENTION STRUCTURE

(71) Applicant: ASIA VITAL COMPONENTS CO., LTD., New Taipei (TW)

(72) Inventor: Chu-Hsien Chou, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 100 days.

(21) Appl. No.: 16/503,477

(22) Filed: Jul. 4, 2019

(65) Prior Publication Data

US 2021/0003135 A1 Jan. 7, 2021

(51) Int. Cl.

| | |
|---|---|
| ***F04D 19/00*** | (2006.01) |
| ***F04D 29/38*** | (2006.01) |
| ***F04D 29/66*** | (2006.01) |
| ***F04D 29/58*** | (2006.01) |

(52) U.S. Cl.

CPC ..... *F04D 19/007* (2013.01); *F04D 19/002* (2013.01); *F04D 29/388* (2013.01); *F04D 29/5853* (2013.01); *F04D 29/666* (2013.01)

(58) Field of Classification Search

CPC .... F04D 29/325; F04D 29/384; F04D 29/388; F04D 29/666; F04D 29/542; F04D 29/52; F04D 19/007; F04D 19/002; F04D 25/06

See application file for complete search history.

(56) References Cited

U.S. PATENT DOCUMENTS

| | | | |
|---|---|---|---|
| 4,599,081 | A | 7/1986 | Cohen |
| 10,249,947 | B1 | 4/2019 | Chun |
| 2006/0152901 | A1 | 7/2006 | Espinoza-Ibarra et al. |
| 2007/0137647 | A1 | 6/2007 | Dampney |
| 2015/0211536 | A1 | 7/2015 | Wei |
| 2016/0018008 | A1 | 1/2016 | Anderl et al. |
| 2017/0051747 | A1* | 2/2017 | Nakamura ..... F04D 29/522 |
| 2017/0328488 | A1 | 11/2017 | Smith |

FOREIGN PATENT DOCUMENTS

| | | | |
|---|---|---|---|
| CN | 101742887 | A | 6/2010 |
| CN | 104895844 | B | 9/2015 |
| CN | 109373019 | A | 2/2019 |
| TW | M586759 | U | 11/2019 |

* cited by examiner

*Primary Examiner* — Woody A Lee, Jr.
*Assistant Examiner* — Maxime M Adjagbe
(74) *Attorney, Agent, or Firm* — Thomas J. Nikolai; DeWitt LLP

(57) ABSTRACT

A fan backflow prevention structure includes a frame body, a first static blade assembly and a second static blade assembly. The frame body has a peripheral wall. Two end edges of the peripheral wall are respectively formed as an air inlet and as an air outlet. A base seat is correspondingly disposed at the air outlet. The first static blade assembly extends outward from the base seat and includes multiple static blade sections. Two ends of each static blade section are respectively connected with the base seat and the peripheral wall. The second static blade assembly is disposed at the air outlet and rotatably coupled to the base seat. The second static blade assembly has a connecting section and multiple stop sections extending outward from the connecting section.

10 Claims, 5 Drawing Sheets

FAN BACKFLOW PREVENTION STRUCTURE

BACKGROUND OF THE INVENTION

1. Field of the Invention

The present invention relates generally to a fan backflow prevention structure, and more particularly to a fan backflow prevention structure, which is able to prevent the air from flowing back to the air inlet and greatly enhance the heat dissipation efficiency.

2. Description of the Related Art

In order to meet the requirement of uninterruption power of a server, the server is equipped with multiple fans to dissipate the heat. When any of the fans of the server fails, the rests of the fans can still normally operate to provide heat dissipation function. However, the failing fan will stop rotating and cannot create push force. Under such circumstance, the pressure at the air outlet is greater than the pressure of the air inlet so that the air at the air outlet will flow through the failing fan back to the air inlet. This will indirectly affect the heat dissipation performance of the other fans in normal operation.

Please refer to FIGS. 1 and 2. In order to avoid air backflow phenomenon caused by the failing fan, conventionally each fan 1 is additionally equipped with a backflow prevention device 12 in the form of a blind. The fan includes a frame body 10, multiple blades mounted in the frame body 10 in adjacency to an air inlet 100 and multiple static blades 11 integrally formed with the frame body 10 in adjacency to an air outlet 101. In operation, the blades rotate around a shaft to create airflow incoming from the air inlet 100 and flowing out from the air outlet 101. The static blades are stationary relative to the frame body 10. The arrangement angle and object of the static blades are determined by the requirement. In general, the static blades serve to concentrate the scattered airflow to enhance the wind pressure. The backflow prevention device 12 includes a fixed frame 120 fixed to the air outlet 101 of the fan 1 and multiple movable members 121 arranged in the fixed frame 120 in parallel to each other.

In normal operation, the movable members 121 of the backflow prevention device 12 of the fan 1 are opened to contain an approximately 90-degree angle with the plane defined by the fixed frame 120 as shown in FIG. 1. In case of failure of the fan 1, the movable members 121 of the backflow prevention device 12 are closed to overlap each other as shown in FIG. 2 so as to avoid air backflow at the air outlet 101.

Such backflow prevention device 12 can achieve the object of backflow prevention. However, the arrangement of the backflow prevention device 12 will reduce the air outgoing area. In addition, the backflow prevention device 12 will lead to increase of the total thickness of the fan 1 to occupy more room. Moreover, the conventional backflow prevention device 12 is an external device additionally mounted on the fan 1 to avoid air backflow. This will greatly increase the manufacturing cost of the fan 1 and prolong the working time. In addition, in normal operation of the fan 1, the movable members 121 are arranged in parallel to each other to affect the preset wind direction and pressure of the fan 1 and deteriorate the performance of the fan 1.

According to the above, the conventional backflow prevention device has the following shortcomings:

1. The air will flow back to the air inlet.
2. The heat dissipation efficiency is deteriorated.
3. The manufacturing cost is increased and the working time is prolonged.

It is therefore the applicant's objective to provide a fan backflow prevention structure to solve the above problems existing in the conventional fan backflow prevention structure.

SUMMARY OF THE INVENTION

It is therefore a primary object of the present invention to provide a fan backflow prevention structure, which is able to prevent the air from flowing back to the air inlet.

It is a further object of the present invention to provide the above fan backflow prevention structure, which can greatly enhance the heat dissipation efficiency of the fan.

It is still a further object of the present invention to provide the above fan backflow prevention structure, which can greatly lower the manufacturing cost and shorten the working time.

To achieve the above and other objects, the fan backflow prevention structure of the present invention includes a frame body, a first static blade assembly and a second static blade assembly. The frame body has a peripheral wall. Opposed end edges of the peripheral wall respectively define an air inlet and an air outlet. A base seat is correspondingly disposed at the air outlet. The first static blade assembly extends outward from the base seat and includes multiple static blade sections. Two ends of each static blade section are respectively connected with the base seat and the peripheral wall. The second static blade assembly is disposed at the air outlet and rotatably assembled with the base seat. The second static blade assembly has a connection section and multiple stop sections extending outward from the connection section.

According to the structural design of the present invention, when the fan of a server normally operates, the second static blade assembly will overlap the first static blade assembly on the fan frame body. When one of the fans of the server fails, (for example, the fan malfunctions or stops operating and is in a stationary state), the second static blade assembly mounted on the fan frame body will rotate through an angle to become misaligned from the first static blade assembly. Under such circumstance, the stop sections are correspondingly positioned in the flow ways formed between the static blade sections so as to block backflow of the air at the air outlet. Accordingly, the stop sections serve as stop components capable of preventing the air at the fan outlet from flowing back to the air inlet. Therefore, it is unnecessary to provide additional backflow prevention device as in the above described prior art so that the manufacturing cost is greatly lowered and the working time is greatly shortened and the heat dissipation efficiency can be enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
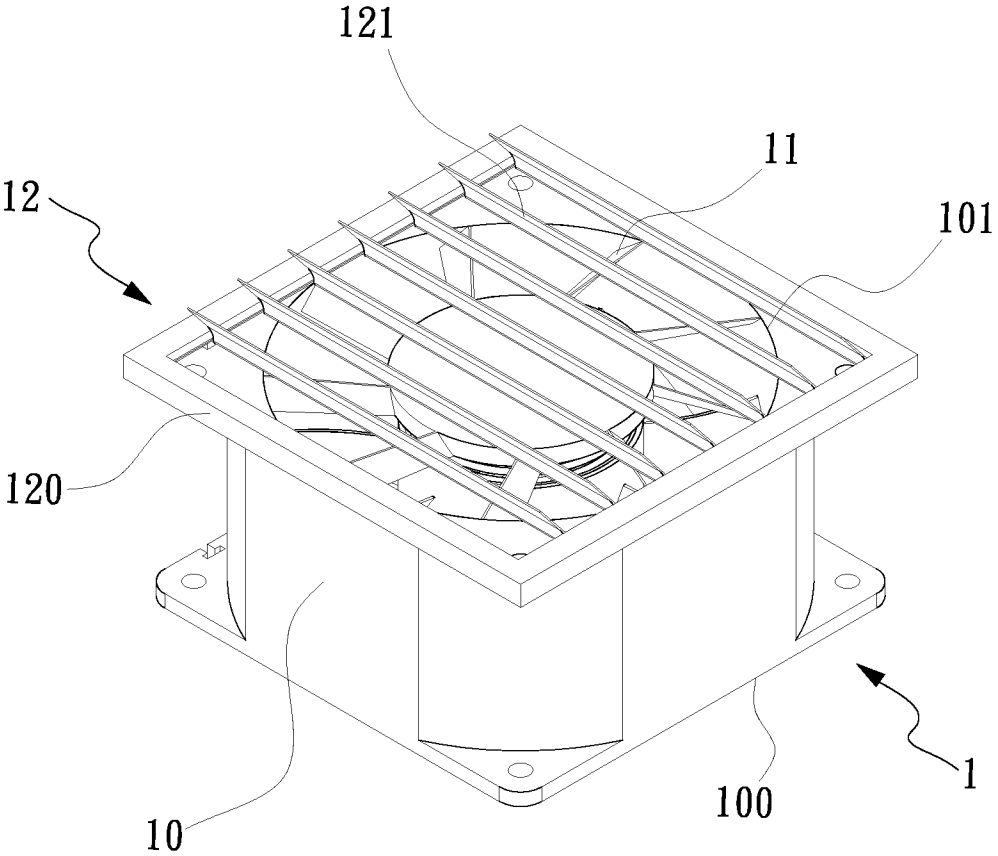
(PRIOR ART) Fig. 1
FIG. 1 is a perspective view of a fan incorporating a conventional backflow prevention structure.
Figure 2:
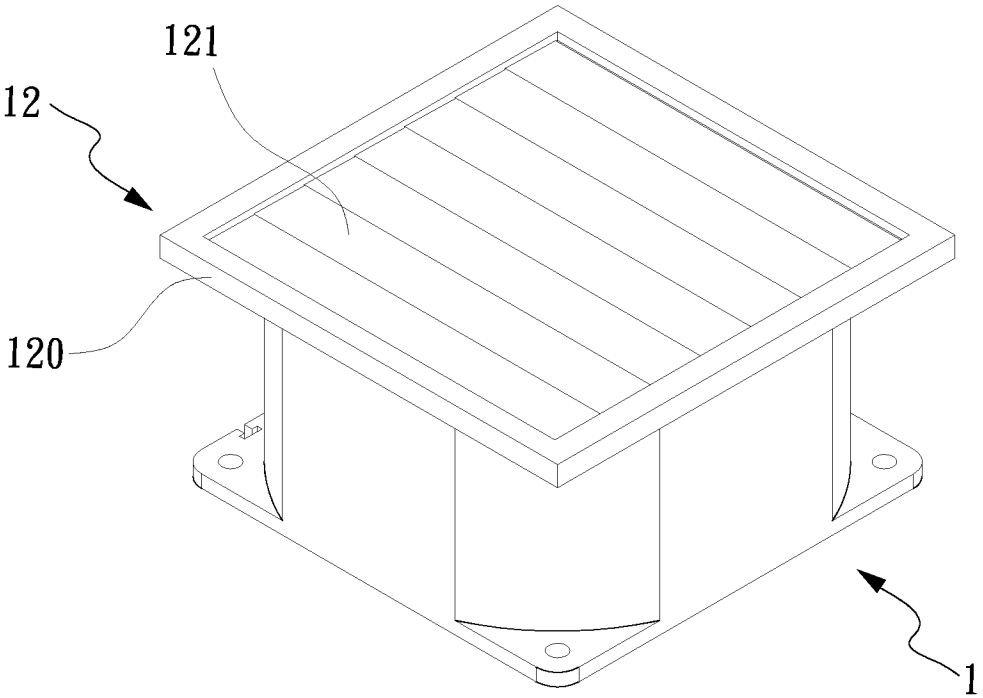
(PRIOR ART) Fig. 2
FIG. 2 is a perspective view of the conventional fan backflow prevention structure, showing the operation thereof.
Figure 3:
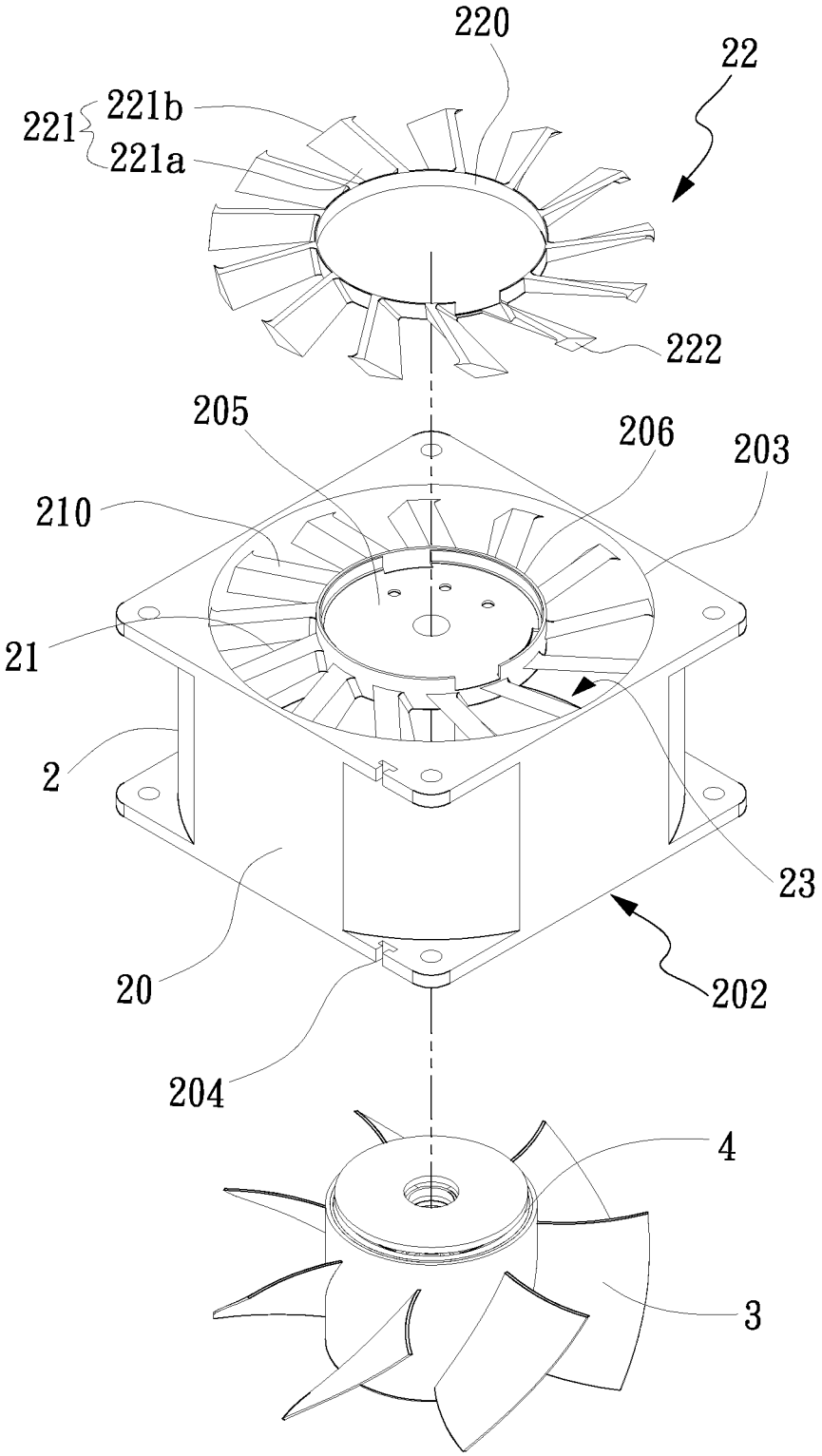
FIG. 3 is a perspective exploded view of the fan backflow prevention structure of the present invention.
Figure 4:
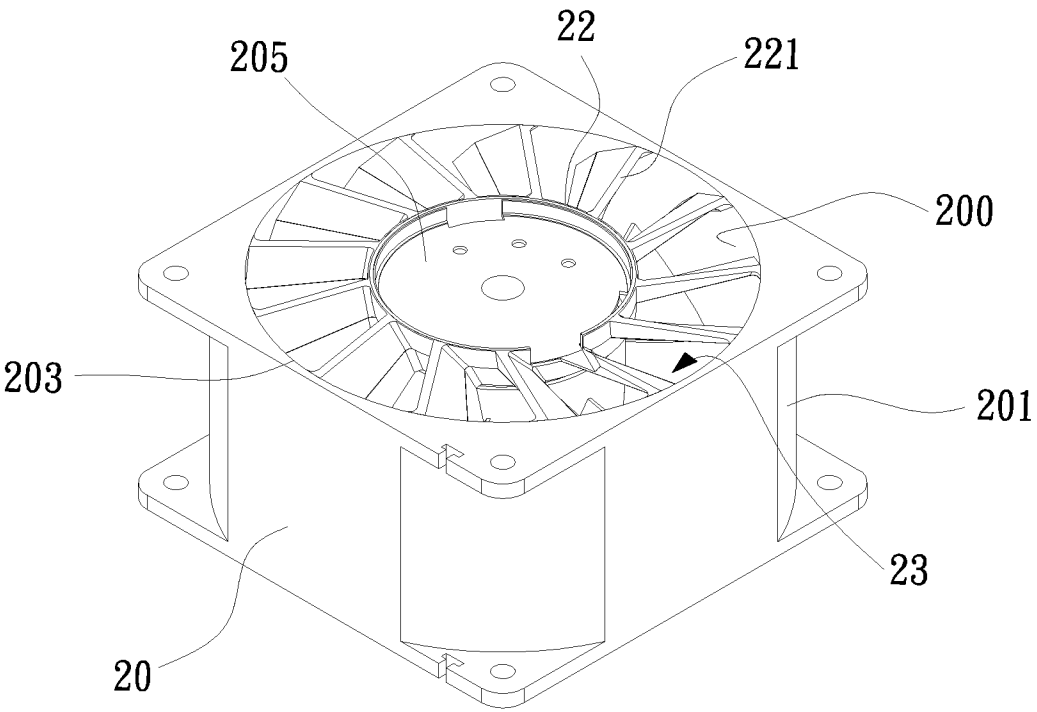
FIG. 4 is a perspective assembled view of the fan backflow prevention structure of the present invention.

Please refer to FIGS. 3 and 4. FIG. 3 is a perspective exploded view of the fan backflow prevention structure of the present invention. FIG. 4 is a perspective assembled view of the fan backflow prevention structure of the present invention. According to the first embodiment, the fan backflow prevention structure of the present invention includes a frame body 2, a first static blade assembly 21 and a second static blade assembly 22. The frame body 2 has a peripheral wall 20 composed of an inner wall 200 and an outer wall 201. Two opposed edges of the peripheral wall 20 are respectively formed with an air inlet 202 and an air outlet 203. A base seat 205 is correspondingly disposed at the air outlet 203. In addition, the air inlet 202 and the air outlet 203 together define a receiving space 204, in which a fan impeller 3 and a stator assembly 4 are received. It should be noted that the structures of the fan impeller 3 and the stator assembly 4 pertain to prior art and thus will not be redundantly described hereinafter.

The first static blade assembly 21 radially extends from the base seat 205. The first static blade assembly 21 includes multiple static blade sections 210. Two ends of each static blade section 210 are respectively connected with the outer circumference of the base seat 205 and the inner wall 200 of the frame body 2. Each two static blade sections 210 define therebetween a flow way 23 in communication with the air outlet 203. In this embodiment, the first static blade assembly 21, the frame body 2 and the base seat 205 are formed as an integrated structure. In practice, according to the requirement of a user, the components can be first respectively formed and then joined with each other. This will not affect the effect achieved by the present invention.

The second static blade assembly 22 is also disposed at the air outlet 203 and rotatably mounted with the base seat 205. More specifically, the base seat 205 is further formed with a hub section 206 protruding from the outer circumference of the bottom section of the base seat 205. The second static blade assembly 22 has a connecting an section 220 correspondingly disposed on the hub section 206. Multiple stop sections 221 extend outward extend from the connecting section 220. In this embodiment, the connecting section 220 and the stop sections 221 are formed as an integrated structure. The stop sections 221 radially extend outward from the connecting section 220 and are arranged at intervals.

Each stop section 221 has a first end 221*a* and a second end 22 lb. The first end 221*a* is correspondingly connected with the connecting section 220. The second end 221*b* abuts against the inner wall 200 of the frame body 2. It should be noted that the stop sections 221 of the second static blade assembly 22 are arranged by an angle identical to that of the static blade sections 210 of the first static blade assembly 21. Therefore, when the connecting section 220 of the second static blade assembly 22 is mounted on the hub section 206 of the base seat 205, the stop sections 221 of the second static blade assembly 22 are overlapped with the static blade sections 210 of the first static blade assembly 21.

In addition, it should be noted that the structures of the static blade sections 210 of the first static blade assembly 21 and the stop sections 221 of the second static blade assembly 22 are, but not limited to, in the form of the static blades of a common fan in the market. Alternatively, the structures of the static blade sections 210 and the stop sections 221 can have form of ribs instead of the static blades.

The second end 221*b* of the stop section 221 further has an abutment section 222 protruding outward from the second end 221*b*. The abutment section 222 correspondingly abuts against the inner wall 200 of the peripheral wall 20 of the frame body 2. The abutment section 222 serves to prevent the second static blade assembly 22 from continuously rotating around the hub section 206 of the base seat 205.

Figure 5:
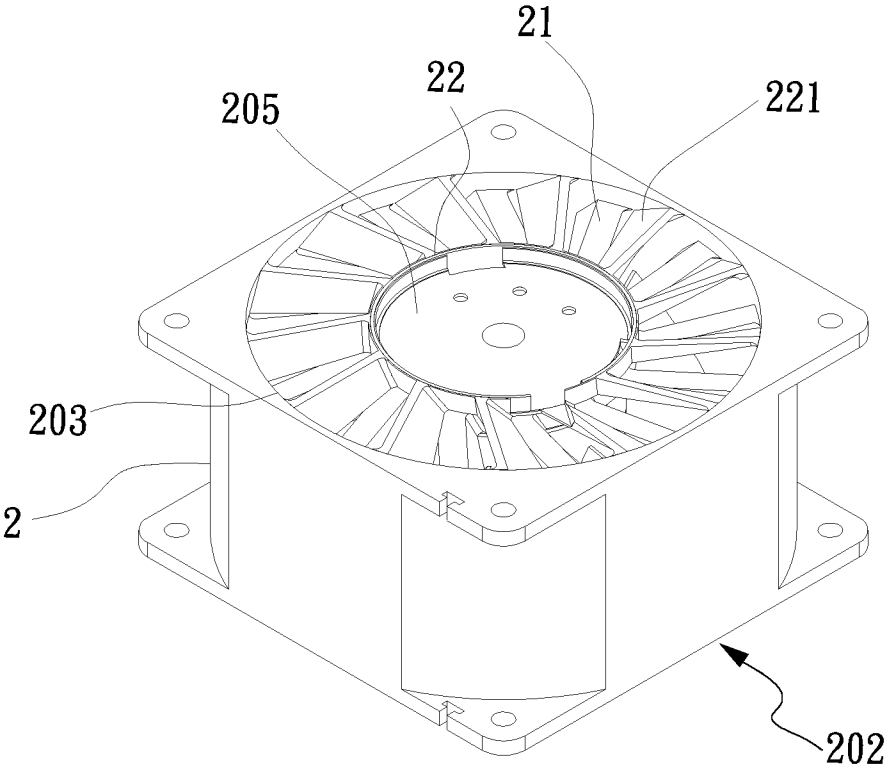
FIG. 5 is a perspective assembled view of the fan backflow prevention structure of the present invention, showing the operation thereof.

Please now refer to FIG. 5, which is a perspective assembled view of the fan backflow prevention structure of the present invention, showing the operation thereof. According to the structural design of the present invention, when the fan of a server normally operates, the second static blade assembly 22 will overlap the first static blade assembly 21 on the fan frame body 2. In this case, the airflow incoming from the air inlet 202 will successfully flow to the air outlet 203 to discharge from the air outlet 203. When one of the fans of the server fails, (for example, the fan malfunctions or stops operating and is in a stationary state), the second static blade assembly 22 connected on the fan frame body 2 will rotate PA through an angle to misalign from the first static blade assembly 21. Under such circumstance, the stop sections 221 are correspondingly positioned in the flow ways formed between the static blade sections 210 so as to avoid backflow of the air at the air outlet 203. Accordingly, the stop sections 221 serve as stop components capable of preventing the air from flowing back to the air inlet 202. Therefore, it is unnecessary to provide additional backflow prevention device as the conventional technique so that the manufacturing cost is greatly lowered and the working time is greatly shortened and the heat dissipation efficiency can be enhanced.

In conclusion, in comparison with the conventional backflow prevention device, the present invention has the following advantages:

1. The present invention is able to prevent the air from flowing back to the air inlet.
2. The heat dissipation efficiency is greatly enhanced.
3. The manufacturing cost is greatly lowered and the working time is greatly shortened.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan backflow prevention structure comprising:

a frame body having a peripheral wall, opposed end edges of the peripheral wall being respectively formed as an air inlet and as an air outlet, a base seat being correspondingly disposed at the air outlet;

a first static blade assembly extending outward from the base seat, the first static blade assembly including multiple static blade sections, two ends of each static blade section being respectively connected with the base seat and the peripheral wall, and each two static blade sections defining therebetween a flow way in connection with the air outlet;

a second static blade assembly disposed at the air outlet to overlap the first static blade assembly and rotatably mounted to the base seat, the second static blade assembly having a connecting section, with multiple stop sections extending outward from the connecting section; and wherein the second static blade assembly is adapted to rotate through an angle to misalign from the first static blade assembly, and the stop sections being correspondingly positioned in the flow ways formed between the static blade assembly sections so as to avoid backflow of the air at the air outlet.

2. The fan backflow prevention structure as claimed in claim 1, wherein the first static blade assembly and the frame body are integrally formed.

3. The fan backflow prevention structure as claimed in claim 1, wherein the connecting section and the multiple stop sections are integrally formed, the stop sections radially outward extending from the connecting section and being arranged at spaced apart intervals.

4. The fan backflow prevention structure as claimed in claim 1, wherein the base seat is further formed with a hub section protruding from an outer circumference of a bottom section of the base seat, the connecting section being correspondingly connected and disposed on the hub section.

5. The fan backflow prevention structure as claimed in claim 1, wherein the peripheral wall has an inner wall and an outer wall, the static blade sections of the first static blade assembly being connected with the inner wall.

6. The fan backflow prevention structure as claimed in claim 5, wherein each stop section has a first end and a second end, the first end being connected with the connecting section, the second end correspondingly abutting against the inner wall.

7. The fan backflow prevention structure as claimed in claim 6, wherein the second end further has an abutment section protruding outward from the second end, the abutment section correspondingly abutting against the inner wall.

8. The fan backflow prevention structure as claimed in claim 1, wherein the stop sections are correspondingly overlapped with the static blade assembly sections.

9. The fan backflow prevention structure as claimed in claim 1, wherein the stop sections of the second static blade assembly being correspondingly disposed in the flow way.

10. The fan backflow prevention structure as claimed in claim 1, wherein the air inlet and the air outlet together define a receiving space, a fan impeller and a stator assembly being correspondingly received in the receiving space.

* * * * *